US006053465A

United States Patent [19]

Kluge

[11] Patent Number: 6,053,465

[45] Date of Patent: Apr. 25, 2000

[54] SHELF AND CLOTHES ROD BRACKET

[75] Inventor: Richard G. Kluge, Lake Geneva, Wis.

[73] Assignee: John Sterling Corporation, Richmond, Ill.

[21] Appl. No.: 09/083,649

[22] Filed: May 23, 1998

[51] Int. Cl.[7] ..... F24H 9/06

[52] U.S. Cl. ..... 248/235; 248/201; 248/247; 248/248; 248/251

[58] Field of Search ..... 248/235, 238, 248/251, 201, 247, 248; 211/124, 162, 105.4, 105.1, 105.2

[56] References Cited

U.S. PATENT DOCUMENTS

| | | | |
|---|---|---|---|
| 481,177 | 8/1892 | Ireland | 248/247 |
| 918,415 | 4/1909 | Berger | 248/247 |
| 1,083,763 | 6/1914 | Smedberg | 248/248 |
| 1,856,044 | 4/1932 | Stowell | 248/247 |
| 2,859,879 | 11/1958 | Rogers et al. | 248/247 |
| 2,886,278 | 5/1959 | Opie | 28/251 |
| 2,903,223 | 9/1959 | De Gray | 248/251 |
| 2,908,471 | 10/1959 | Hollansworth | 248/251 |
| 3,669,395 | 6/1972 | Gehrke | 248/235 |
| 5,531,416 | 7/1996 | Remmers | 248/201 |
| 5,592,303 | 1/1997 | Sloan . | |
| 5,755,416 | 5/1998 | Leek | 248/247 |
| 5,758,851 | 6/1998 | Remmers | 248/251 |

*Primary Examiner*—Anita M. King
*Assistant Examiner*—Debbie Short
*Attorney, Agent, or Firm*—McCaleb, Lucas & Brugman

[57] ABSTRACT

A combination shelf and clothes rod support bracket formed by a single, elongated, metal strap reinforced by raised ribs, having two bends to form a linear mounting leg and a linear shelf support leg related at right angles. An angle brace extends between the two legs to form a rigid triangular structure. A clothes rod support has a leg portion fixed to the angle brace adjacently beneath the shelf support leg and includes a forwardly and downwardly extending arm portion and an upwardly extending finger portion forming a hook having a semi-cylindrical lip at the outer end of the upwardly extending finger portion. The lip portion engageably under-supports a cylindrical clothes rod. The forward and upward extent of the hook and the position of the rod engaging lip is such that a conventional clothes hanger having its hook engaged with the clothes rod is freely slidable along the clothes rod without engaging any part of the support bracket.

3 Claims, 2 Drawing Sheets

SHELF AND CLOTHES ROD BRACKET

This invention concerns support brackets and more particularly an improved shelf and clothes rod support bracket which afford free unobstructed movement of conventional clothes hangers along a clothes rod suspended beneath a horizontal shelf.

BACKGROUND OF THE INVENTION

It is common practice to mount cylindrical clothes rods on end brackets engaging opposite rod ends. If the length of the clothes rod is relatively short and the rod itself is sufficiently stiff and strong, there is no need for an additional support intermediate the rod ends. That being the case, a conventional clothes hanger having its hook-like hanger engaged over the clothes rod is freely moveable between the rod ends.

In the event a longer clothes rod is needed, as in a double width closet, it will be recognized immediately that support of the rod intermediate its ends, is desirable if not necessary to prevent the clothes rod from bending or breaking under a heavy load. End brackets for supporting the opposite ends of the clothes rod are not suitable for supporting the rod intermediate its ends.

Typical of prior art developments to solve this problem is the shelf and pole bracket of U.S. Pat. No. 2,859,879 issued Nov. 11, 1958 to D. R. Rogers et al. wherein a shelf supporting bracket has a depending hook at the outer end of a horizontal shelf supporting arm. The hook is semi-cylindrical or U-shaped at its lower end for receiving a clothes rod or pole. While this arrangement has been used for a number of years, it has a major drawback. One cannot slide a clothes hanger along the clothes pole or rod past the pole engaging hook of the support bracket. Consequently, removal of the clothes hanger from the rod to the other side of the pole engaging hook is necessary.

A more recent U.S. Pat. No. 5,582,303, issued Dec. 10, 1996, to Stewart S. Sloan, avoids the aforementioned shortcoming of the Rogers et al. patent by providing a special formed hook depending from the outer end of a horizontal shelf supporting arm. The hook of this patent carries an arcuate clothes rod supporting member which engages and is fastened to the underside of a wooden clothes rod, leaving sufficient clearance for the unobstructed passage of a clothes hanger hook along the length of the clothes pole. However, the structure of this patent is not wholly satisfactory from a load bearing and structural standpoint.

BRIEF SUMMARY OF THE INVENTION

The combined shelf and clothes rod support bracket of this invention comprises a triangular support in which the three legs of the triangle have a reinforced cross section to promote structural strength. One leg of the bracket is attachable to the underside of a shelf, while a second leg is attachable to a vertical support surface. The angularly disposed third leg of the bracket acts as a brace between the other two legs and is fitted with a clothes rod supporting hook that extends forwardly and downwardly from the angle brace with the outer end of the hook extending angularly upward in substantial alignment with the outer end of the shelf supporting leg. An arcuately curved member is provided at the outer extreme of the hook member to engage and undersupport a clothes pole thereon.

It is an object of this invention to provide an improved shelf and clothes rod support bracket.

A further object of this invention is to provide an improved bracket, as set out in the preceding object, which is marked by improved economies of production while promoting enhanced structural characteristics.

Having described this invention, the above and further objects, features and advantages thereof will be recognized from the following detailed description of a preferred embodiment thereof, illustrated in the accompanying drawings.

IN THE DRAWINGS

DESCRIPTION OF THE PREFERRED EMBODIMENT

Figure 1:
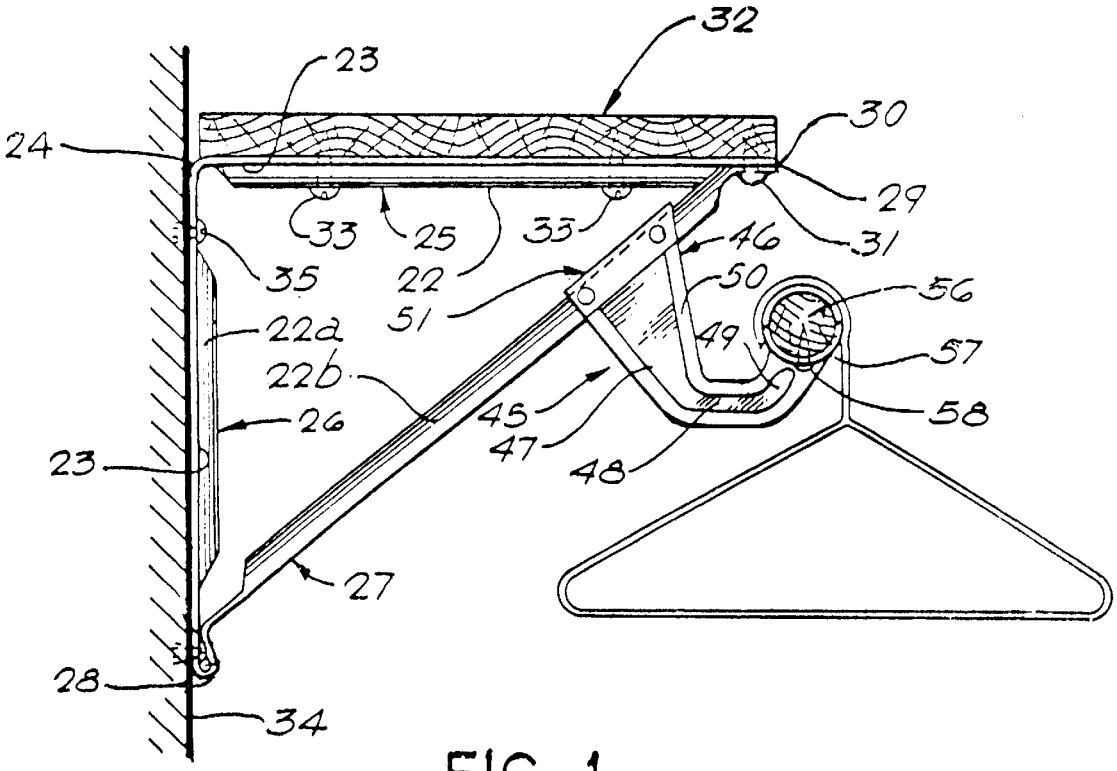
FIG. 1 is a side elevational view of and improved bracket embodying this invention assembled with a shelf and clothes rod.
Figure 2:
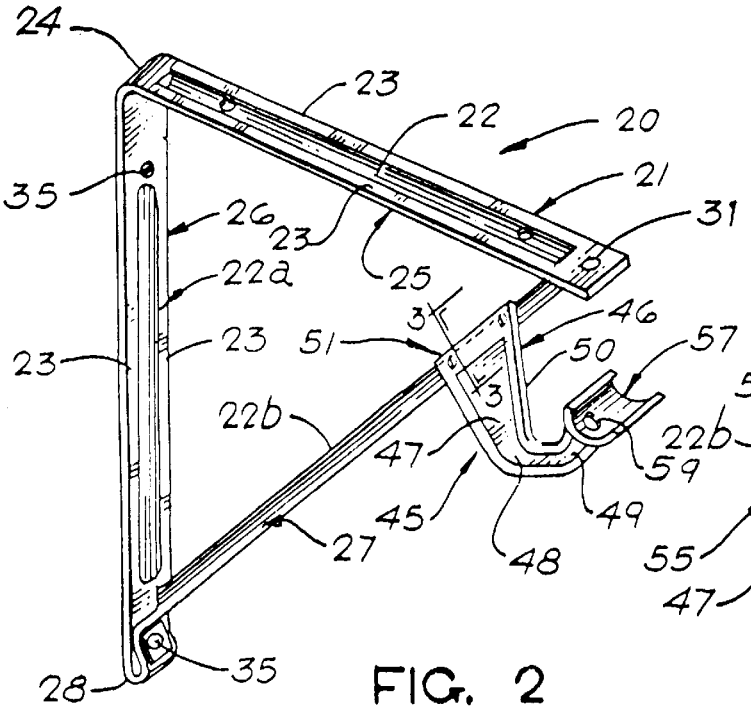
FIG. 2 is a perspective view of the bracket shown in FIG. 1.
Figure 3:
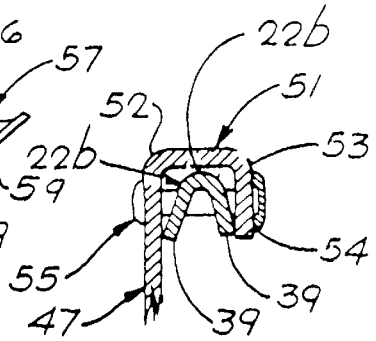
FIG. 3 is an enlarged, partial cross section taken along vantage line 3—3 of FIG. 2 looking in the direction of the arrows.

Referring to FIGS. 1–3 of the drawings, the features of a preferred embodiment of the invention will now be described.

As shown a shelf and clothes rod support bracket, indicated generally at 20, comprises a one piece metal strap 21, which is stamped or otherwise formed or bent to provide centrally extending, raised reinforcing beads 22, 22*a* and 22*b*, which are generally U-shaped in cross section. Strap 21 is folded at 24 to provide two equal length, right angularly related linear legs 25 and 26. A longer angle brace 27 is formed by reentrantly bending one end of the strap 21, indicated at 28, to angularly align brace 27 to extend between the lower end of leg 26 and the outer end of leg 25. The outer end of brace 27 is formed as a planar tab 29 aligned to engage a planar tongue portion 30 at the outer end of the leg 25 to which the brace is fixed, as by welding or rivet connector 31. This triangular structure with raised reinforcing beads along each of the legs 25 and 26 and brace 27 makes for a rigid high strength structure capable of withstanding fairly heavy loads.

It will be recognized from FIG. 1 in particular that leg 25 is oriented horizontally and is dedicated to undersupporting a horizontal shelf 32, to which leg 25 is attached by wood screws 33 that extend through the reinforcing bead 22 (see FIG. 1).

The configuration of like bead sections 22, 22*a* is apparent from FIG. 2, i.e., generally U-shaped in cross section flanked by co-planar flanges 23, 23.

In a similar fashion the operationally upright leg 26 is designed to mount the bracket 20 to a vertical support, such as wall 34, by means of wall anchored screw fasteners 35 (see FIG. 1). It will be noted that openings 36 and 37 are provided in leg 26 and the reentrantly bent portion 28 of the brace 27, respectively, for passage of fasteners 35.

With reference now to FIGS. 2 and 3, it will be seen that bead 22*b* is formed as an inverted open V in section and that arms 39 of the V are relatively wide spread. It further is to be noted that the depth of bead 22*b* is greater than the shallower beads 22 and 22*a*, inasmuch as much of the vertical load on bracket 20 is transmitted to the vertical support wall via brace 27; the added depth of bead 22*b* providing greater strength to the brace.

It will be recalled that brackets of this invention are intended to support not only horizontal shelves, such is shelf 32 shown, but also clothes rods.

Figure 4:
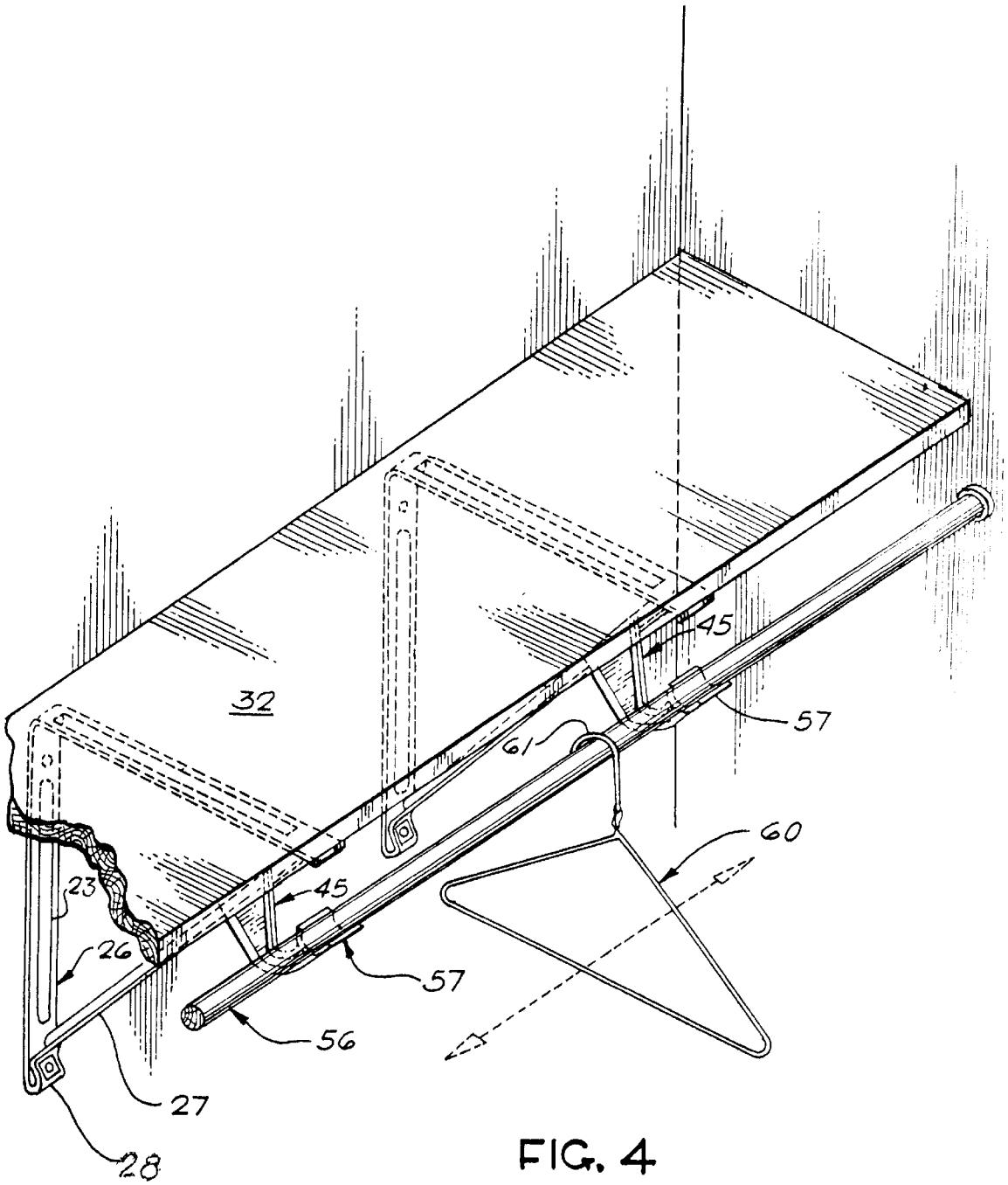
FIG. 4 is a top frontal perspective view of a clothes rod and shelf installation using the improved bracket of this invention.

The shelf supporting function has been described above, and to carry out the clothes rod supporting feature, novel clothes rod support means 45 are provided, as best illustrated in FIGS. 1, 2 and 4 in particular.

Support means 45 comprises a stamped metal hook member 46 having a generally trapezoidal shaped body portion 47 contiguous with an integral outwardly extending narrowed horizontal neck portion 48 having an angularly upwardly extending arm portion 49 at its outer end. The stamped formation of the hook member provides a raised rim 50 about its periphery which projects outwardly of one side of the body, neck and arm portions to rigidify and strengthen the hook member.

The widened base end of body portion 47, designated generally at 51, as best shown in FIG. 3, is bent at two right angular bends 52, 53 to provide a short flange 54 extending downwardly from bend 53, parallel to body 47. The spacing between flange 54 and body 47 is such as to frictionally receive and embrace the outer edges of the wide spread arms 39, 39 of reinforcing bead 22*b* therebetween. A pair of elongated rivets 55, 55 extend through body 47, flange 54 and the two spread arms 39, 39 of brace 27; rivets 55 having their outer ends upset outboard of flange 54 whereby to positively fix the hook member 46 to the angle brace 27.

It will be noted that the hook member is located near the upper end of the angular brace 27 so as to extend forwardly beneath the outer edge of shelf 32 (see FIGS. 1 and 4) although placement of the hook 45 may be alternately positioned along brace 27, if desired.

In order for a cylindrical wooden clothes rod or pole 56 to be securely supported by one or more brackets 20 spaced along the pole length (see FIG. 4) a semi-cylindrical lip member 57 is welded to the outer or upper end of the hook's arm portion 49; such lip being oriented at right angles to the plane of hook body 47 to provide an upwardly open cradle receptive of the cylindrical exterior of pole 56. A wood screw 58 passes through one opening 59 in lip 57 to secure the pole on the lip member.

As best illustrated in FIGS. 1 and 4, the formation of the hook member 46 is such that the lip member 57, which holds and locates the clothes pole 56, is displaced by neck portion 48 away from the body portion 47. Thus, when a clothes hanger 60 is mounted on pole 56 so that its conventional hook 61 overengages the pole, the hanger may pass freely along the length of the pole past one or more of the brackets 20 without interfering contact with a support member 45 (see FIGS. 1 and 4).

Having described a preferred embodiment of this invention it will be apparent to those of skill in the art that numerous changes, modifications and substitutions of equivalents may be made in the herein described invention without departing from the true spirit and scope of the invention as defined in the following appended claims.

The embodiments of the invention in which an exclusive property or privilege is claimed are defined as follows:

1. A combined shelf and clothes rod bracket mountable on a vertical support comprising:

a single, elongated, metal strap bent at right angles intermediate opposite ends thereof to define a linear shelf supporting leg attachable to the underside of a horizontal shelf and a linear mounting leg attachable to a vertical support;

a rigid linear brace member generally extending diagonally between said mounting leg and an outer end of said shelf supporting leg;

rod support means for mounting an elongated clothes rod in horizontal position below and forwardly of an outer edge of said shelf comprising a J-hook with a rigid, generally trapezoidal shaped body portion having a first base end fixed intermediate opposite ends of said brace member whereby to extend said J-hook downwardly and forwardly of said brace member; said body portion having an integral neck portion extending horizontally from a second base end thereof; said neck portion having a contiguous arm portion extending upwardly from an outer end of said neck portion; and a semi-cylindrical lip portion fixed transversely across an upper end of said arm portion;

said lip portion presenting a concave cradle receptive of a clothes rod, and means at said first base end of said body portion affixing said rod support means to said brace member.

2. The bracket of claim 1, wherein said first base end is formed to closely embrace said brace member, and said means at said first base end permanently attach said first base end to said brace member.

3. The bracket of claim 1, characterized by a reinforcing bead extending centrally outward of one side and substantially lengthwise of said shelf supporting leg; a corresponding reinforcing bead extending substantially lengthwise of said mounting leg; and a generally inverted bead of V-shaped cross section extending substantially along the length of said brace member to rigidify the bracket.

* * * * *